US010981763B2

(12) United States Patent
Myers et al.

(10) Patent No.: US 10,981,763 B2
(45) Date of Patent: Apr. 20, 2021

(54) WORK TOOL LEVELING SYSTEM

(71) Applicant: Deere & Company, Moline, IL (US)

(72) Inventors: David J. Myers, Dubuque, IA (US); Doug M. Lehmann, Durango, IA (US); Craig A. Conrad, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 379 days.

(21) Appl. No.: 15/805,410

(22) Filed: Nov. 7, 2017

(65) Prior Publication Data

US 2019/0135599 A1 May 9, 2019

(51) Int. Cl.

*B66F 9/075* (2006.01)
*B66F 9/22* (2006.01)
*B66F 9/065* (2006.01)

(52) U.S. Cl.

CPC ..... *B66F 9/0755* (2013.01); *B66F 9/065* (2013.01); *B66F 9/22* (2013.01)

(58) Field of Classification Search

CPC ..... A01C 3/04; B66F 9/065; B66F 9/0755; B66F 9/22; E02F 3/34; E02F 3/3405; E02F 3/3408; E02F 3/3411; E02F 3/3414; E02F 3/342; E02F 3/42; E02F 3/422; E02F 3/43; E02F 3/431; E02F 3/432; E02F 3/433; E02F 3/436

USPC ..... 414/566, 685, 697, 700, 701, 706, 707, 414/708

See application file for complete search history.

(56) References Cited

U.S. PATENT DOCUMENTS

| | | | | |
|---|---|---|---|---|
| 5,363,304 | A | 11/1994 | Awano et al. | |
| 7,530,185 | B2 | 5/2009 | Trifunovic | |
| 7,748,147 | B2 | 7/2010 | Schoenmaker et al. | |
| 7,752,778 | B2 | 7/2010 | Schoenmaker et al. | |
| 7,752,779 | B2 | 7/2010 | Schoenmaker et al. | |
| 7,797,860 | B2 | 9/2010 | Schoenmaker et al. | |
| 8,155,844 | B2 | 4/2012 | Ole | |
| 8,500,387 | B2 | 8/2013 | Trifunovic | |
| 8,974,171 | B2 | 3/2015 | Shirao et al. | |
| 9,598,845 | B2 | 3/2017 | Baba et al. | |
| 9,752,336 | B2 | 9/2017 | Meinert | |
| 2002/0073833 | A1 | 6/2002 | Coombs et al. | |
| 2008/0263911 | A1 | 10/2008 | Shoenmaker et al. | |
| 2009/0162177 | A1* | 6/2009 | Nichols | E02F 3/431 414/698 |
| 2010/0215469 | A1* | 8/2010 | Trifunovic | E02F 3/432 414/699 |

(Continued)

*Primary Examiner* — Saul Rodriguez
*Assistant Examiner* — Brendan P Tighe

(57) ABSTRACT

In accordance with an example embodiment, a work vehicle may include a chassis, a linkage, a work tool, first and second actuators connected to linkage, one or more sensors, and a controller. The work tool is movably connected to the chassis by the linkage and pivotally connected to the linkage about a base axis. The work tool includes a tip positioned at a forward end of the work tool, with a tip axis parallel to the base axis and passing through the tip. The one or more sensors are configured to provide one or more signals indicative of at least one of a position, velocity, and acceleration of the work tool. The controller is configured to actuate, based on the one or more signals, the first actuator and the second actuator to level the work tool by rotating the work tool about the tip axis.

15 Claims, 3 Drawing Sheets

(56) References Cited

U.S. PATENT DOCUMENTS

| | | | | |
|---|---|---|---|---|
| 2010/0226744 | A1* | 9/2010 | Trifunovic | E02F 3/434<br>414/700 |
| 2010/0254793 | A1* | 10/2010 | Trifunovic | E02F 3/432<br>414/700 |
| 2012/0057956 | A1 | 3/2012 | Shirao et al. | |
| 2014/0095036 | A1* | 4/2014 | Hoff | E02F 9/2253<br>701/65 |
| 2014/0129093 | A1* | 5/2014 | Shirao | E02F 3/433<br>701/50 |
| 2016/0295814 | A1 | 10/2016 | Raszga et al. | |
| 2016/0319511 | A1 | 11/2016 | Chang et al. | |

* cited by examiner

WORK TOOL LEVELING SYSTEM

TECHNICAL FIELD

The present disclosure generally relates to a control system and method for leveling a work tool connected by a linkage to a work vehicle.

BACKGROUND

Work vehicles may be used with work tools to engage and move loads. An example of such a work tool is a set of forks, often two flat tines separated by a distance and designed to engage slots in a pallet to allow the work vehicle to lift and move the pallet. The work vehicles are often capable of both raising and lowering the forks, and tilting the forks.

To fully engage the slots in a pallet, the work vehicle usually must have the forks both at the right height for the slots and level enough such that the tines of the forks may be inserted into the slots to a sufficient depth to handle the load on the pallet, without damage to the forks or the pallet.

SUMMARY

Various aspects of examples of the present disclosure are set out in the claims.

According to a first aspect of the present disclosure, a work vehicle may include a chassis, a linkage, a work tool, first and second actuators connected to the linkage, one or more sensors, and a controller. The work tool is movably connected to the chassis by the linkage and pivotally connected to the linkage about a base axis. The work tool includes a tip positioned at a forward end of the work tool, with a tip axis parallel to the base axis and passing through the tip. The one or more sensors are configured to provide one or more signals indicative of at least one of a position, velocity, and acceleration of the work tool. The controller is configured to actuate, based on the one or more signals, the first actuator and the second actuator to level the work tool by rotating the work tool about the tip axis.

According to a second aspect of the present disclosure, a method for controlling such a work tool may include receiving the one or more sensor signals at the controller and controlling, with the controller, the actuation of a tilt actuator and a lift actuator to rotate the work tool about the tip axis based on the one or more sensor signals, the tilt actuator connected to the linkage and configured to rotate the work tool about the base axis when actuated, the lift actuator connected to the linkage and configured to raise or lower the base axis when actuated.

According to a third aspect of the present disclosure, a work vehicle may include a chassis, linkage, set of forks, lift sensor, tilt sensor, and a controller. The linkage may include a boom with a first end pivotally connected to the chassis, lift cylinders pivotally connected at a first end to the chassis and at a second end to the boom, a bellcrank pivotally connected to the boom, a tilt cylinder pivotally connected to a first end of the bellcrank, and a lower link connected at a first end to the second end of the bellcrank. The set of forks is pivotally connected to a second end of the boom about a base axis and pivotally connected to a second end of the lower link. The set of forks includes a tip positioned at a forward end of the set of forks, with a tip axis parallel to the base axis and passing through the tip. The lift sensor is configured to provide a lift signal indicative of an angle of the boom relative to the chassis. The tilt sensor is configured to provide a tilt signal indicative of an angle of the bellcrank relative to the boom. The controller is in communication with the lift sensor and the tilt sensor and configured to actuate the lift cylinders and the tilt cylinder to rotate the set of forks about the tip axis based on the lift signal and the tilt signal.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

Figure 1:
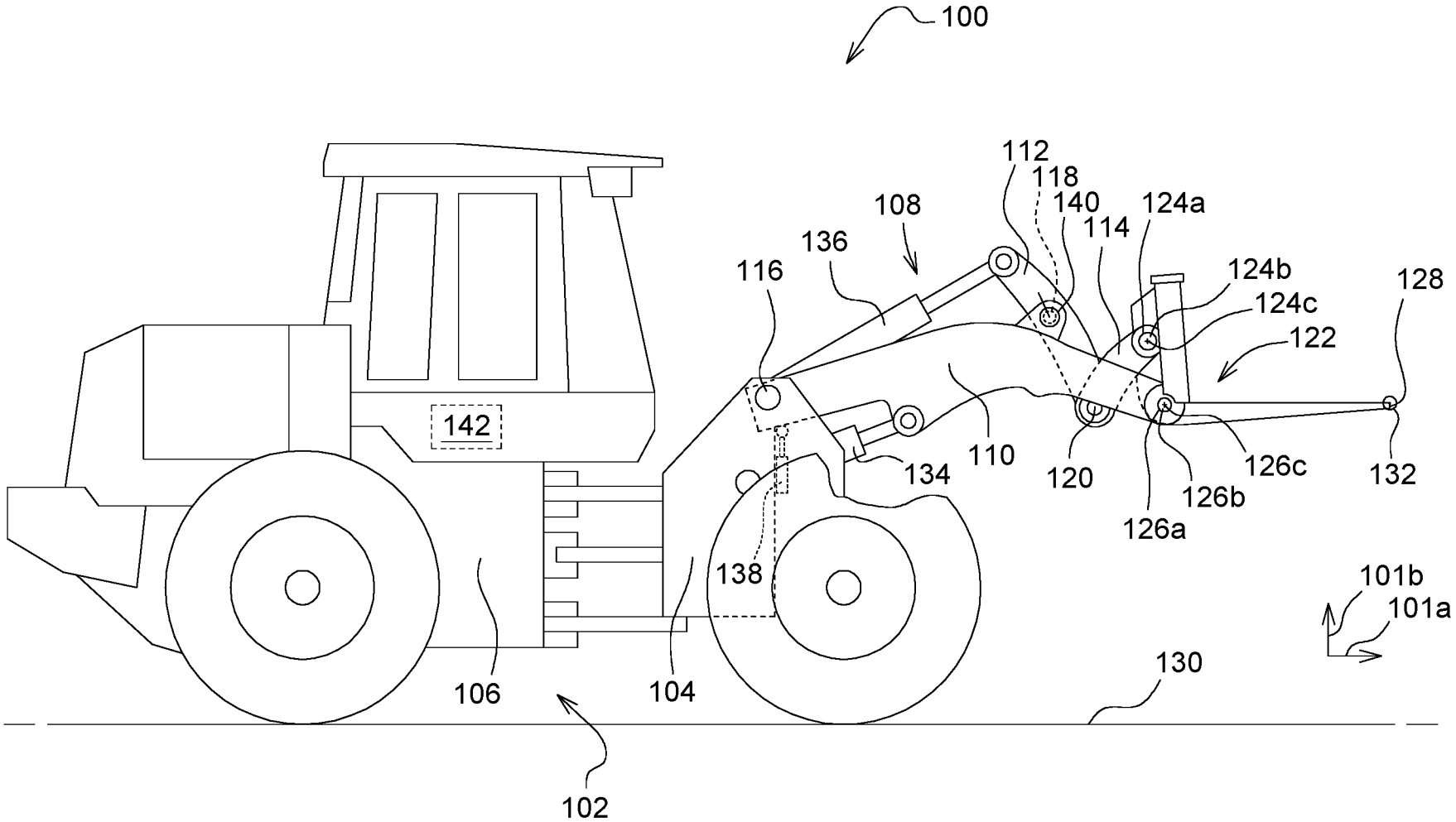
FIG. 1 is a right side view of a work vehicle with a work tool attached via a linkage, with the work tool in a level position.
Figure 2A:
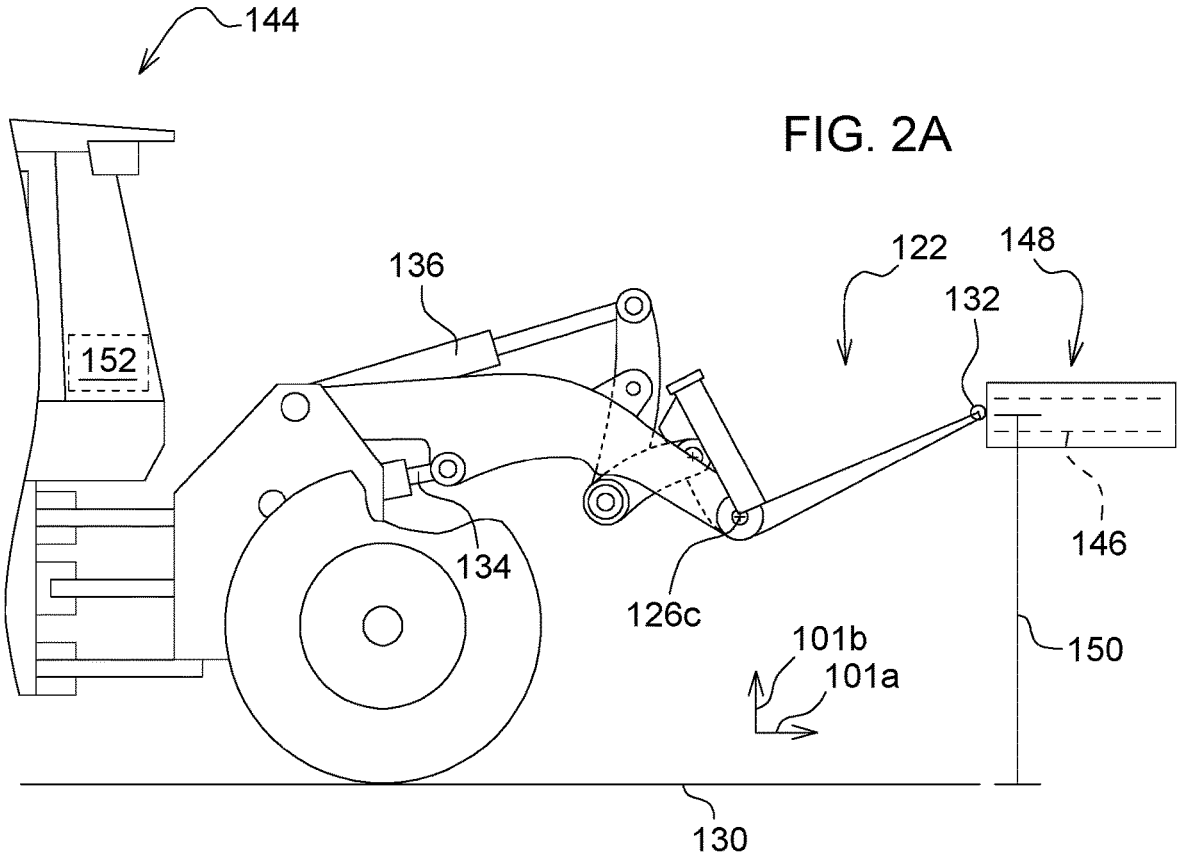
FIG. 2*a* is a right side view of a portion of the work vehicle, with the work tool in a tilted position.
Figure 2B:
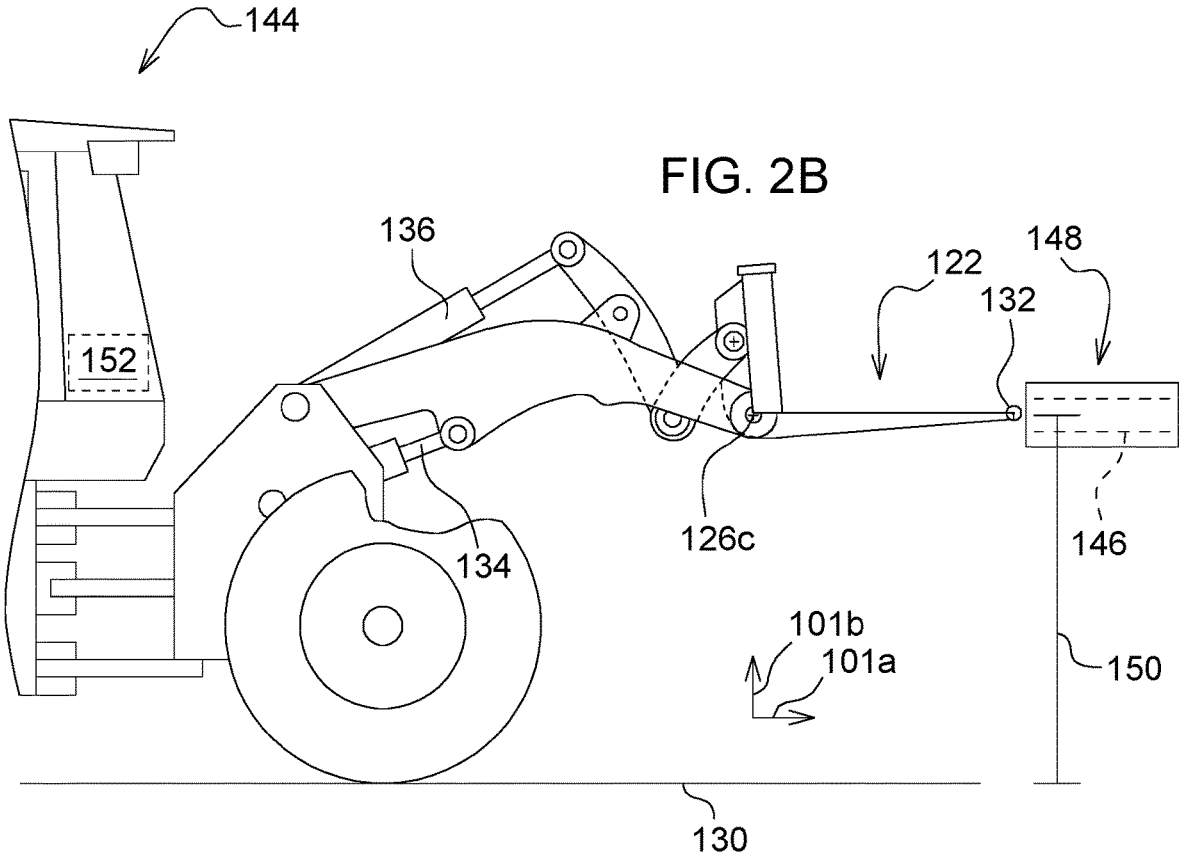
FIG. 2*b* is a right side view of the portion of the work vehicle, with the work tool in the level position.
Figure 3:
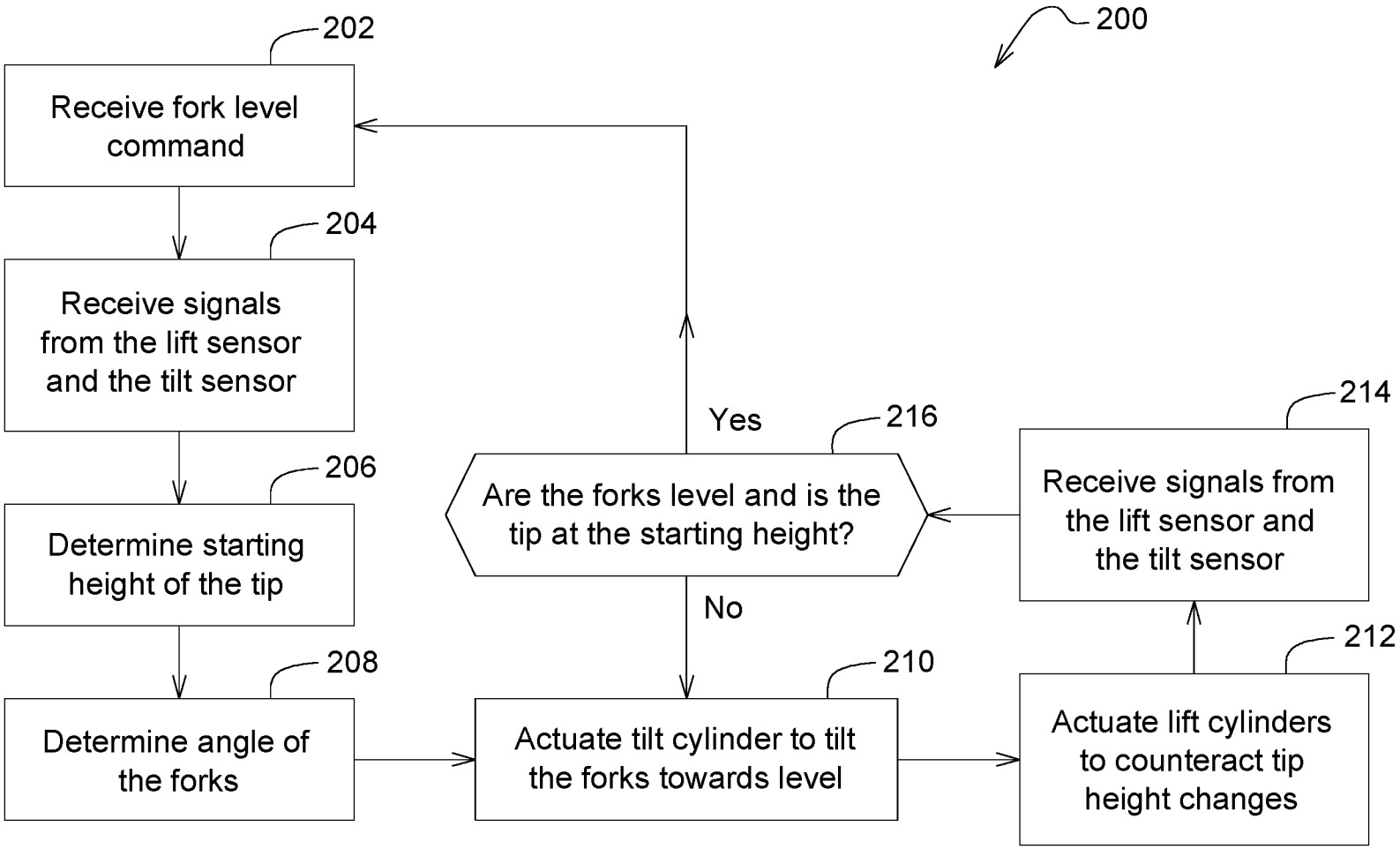
FIG. 3 is a flow chart of a control system for leveling the work tool.

At least one example embodiment of the subject matter of this disclosure is understood by referring to FIGS. 1 through 3 of the drawings.

FIG. 1 depicts a work vehicle 100, which is illustrated as a wheel loader but which could be any of number of other work vehicles where it is desirable to level an attached work tool without changing the height of a particular portion of the work tool, such as backhoes, compact track loaders, crawler loaders, skid steers, and tractors. The work vehicle 100 comprises a rigid chassis 102 to support the work vehicle 100, which in turn comprises a front chassis 104 pivotally connected to a rear chassis 106 so as to enable the work vehicle 100 to be steered by articulation of the chassis 102. In this context, direction 101*a* may be referred to as forward, the opposite of direction 101*a* may be referred to as rearward, direction 101*b* may be referred to as upward, and the opposite of direction 101*b* may be referred to as downward, with height measured along the direction 101*b*.

A linkage 108 is connected to the front chassis 104. The linkage 108 comprises multiple rigid members, including a boom 110, a bellcrank 112, and a lower link 114. The rearward portion of the linkage 108 is connected to the front chassis 104 so as to enable the boom 110, which is comprised of two parallel arms, to pivot relative to the front chassis 104 about the boom pins 116. The bellcrank 112 is connected to the boom 110 so as to enable the bellcrank 112 to pivot relative to the boom 110 about a bellcrank pin 118. The lower link 114 is connected to the bellcrank 112 so as to enable the lower link 114 to pivot relative to the bellcrank 112 about a lower link pin 120. The forward portion of the linkage 108 is connected to a work tool, in this embodiment forks 122, such that the forks 122 are able to be moved upward or downward by the linkage 108, or rotated forward/downward or backward/upward (i.e., clockwise and counterclockwise in FIG. 1, respectively). The forks 122 are of the type commonly used by vehicles to move and transport certain loads, such as pallets containing goods and materials, by driving forward until the forks 122 are engaged in slots or grooves in the pallet, raising the forks 122 to lift the pallet off the surface on which it was resting, and transporting the pallet to another location. The forks 122 may be referred to as forks or a set of forks.

The forks 122 comprise top bore 124*a*, base bores 126*a*, and a tip 128. The top bore 124*a* receives a top pin 124*b* which is also received by a bore in the lower link 114 so as to enable the top bore 124*a* to pivot relative to the lower link 114 about a top axis 124*c* while still being supported by the lower link 114. The base bores 126*a* receive base pins 126*b* which are also received by a bore in each of the two arms of the boom 110 so as to enable the base bores 126*a* to pivot relative to the boom 110 about a base axis 126*c* while still being supported by the boom 110. Although a single bore-and-pin combination is used for the top bore 124*a* and the top pin 124*b* and a pair of co-axial base bores 126*a* receive a pair of co-axial base pins 126*b* in FIG. 1, it is understood that each of the two pivotal connections of the forks 122 to the linkage 108 may utilize any number of co-axial bores and pins, in the same manner that the boom 110 and the bellcrank 112 may be single members or multiple parallel members with co-axial bores and pins.

The tip 128 comprises the forward tips of the forks 122 when the forks 122 are level, or positioned parallel to a ground surface 130 supporting the work vehicle 100 as shown in FIG. 1. Being the forward tips of the forks, the tip 128 is the first portion of the forks 122 to be inserted into slots (e.g., holes, grooves, gaps) when the work vehicle 100 moves forward to engage a pallet or other load. A tip axis 132 is an axis parallel to the base axis 126*c* but offset such that it passes through the tip 128. When the forks 122 first engage a pallet and the tip 128 is positioned at the entrance to the slots, rotation of the forks 122 about the tip axis 132 would not affect the height of the tip 128 in the direction 101*b* and thus should not cause movement of the tip 128 relative to the slots. For example, if the tip 128 is placed at the proper height to engage slots in a pallet, rotation of the forks 122 about the tip axis 132 may be used to level the forks 122 without interfering with the alignment of the tip 128 to the pallet slots.

As used to describe the embodiment shown in FIGS. 1-3, "level" refers to the tines of the forks 122 being level relative to a ground surface 130 supporting the work vehicle 100. Determining whether the forks 122 are level could be done in a number of manners, but one manner would be to determine at what angle of the forks 122 relative to the chassis 102 are the forks 122 level relative to the ground surface 130, and use that angle to level the forks 122 while assuming that the angle of the chassis 102 relative to the ground surface 130 is consistent. In alternate embodiments, level may refer to something other than a level angle relative to the chassis 102 and the ground surface 130, for example it may be level relative to a direction of gravity. As one example, should the ground surface 130 be sloping upward, then the reference plane for "level" for the forks 122 could be the ground surface 130 or it instead could be a plane perpendicular to the direction of gravity. If the direction of gravity is used, the forks 122 may be level though not parallel to the ground surface 130 if the ground surface 130 is angled upward or downward. To determine the direction of gravity in order to use it to form the reference plane, an accelerometer or an IMU (inertial-measurement unit) may be connected to a part of the work vehicle 100, such as the chassis 102, linkage 108, or the forks 122.

The forks 122 are movably connected to the chassis 102, specifically the front chassis 104. This movement is effectuated by three actuators, a pair of lift cylinders 134 and a tilt cylinder 136. The lift cylinders 134 are a pair of hydraulic cylinders which are pivotally connected by pin and bore arrangements at a rearward end to the front chassis 104 and at a forward end to the boom 110. Actuation of the lift cylinders 134 therefore results in rotation of the boom 110 about the boom pin 116. The tilt cylinder 136 is a hydraulic cylinder which is pivotally connected by a pin and bore arrangement at a rearward end to the front chassis 104 and at a forward end to the bellcrank 112. Actuation of the tilt cylinder 136 therefore results in rotation of the bellcrank 112 about the bellcrank pin 118, which results in rotation of the forks 122 about the base axis 126*c*.

Due to the kinematics of the linkage 108, which may be referred to as a Z-bar linkage, the actuation of the lift cylinders 134 may cause both a change in the height of the forks 122 and a change in the tilt of the forks 122 (i.e., the angle of the forks 122 relative to the front chassis 104). In other words, actuation of the lift cylinders 134 may cause both translation of the base pins 126*b* (and thus the base axis 126*c*) as well as the rotation of the forks 122 about the base axis 126*c* relative to the chassis 102. At the tip axis 132, the combined kinematics of the forks 122 and the linkage 108 result in the height of the tip axis 132 being changed by an actuation of the lift cylinders 134 or an actuation of the tilt cylinder 136. In other words, although the lift cylinders 134 and the tilt cylinder 136 are referred to as "lift" and "tilt" cylinders to aid in the description of the work vehicle 100, each cylinder may effectuate both a lifting of the tip 128 of the forks 122 and a tilting of the forks 122 when actuated.

The current kinematics may be determined with knowledge of the geometry and current position of the linkage 108 and the forks 122. The current position of the linkage 108, and thus the forks 122, may be sensed by one or more sensors. For work vehicle 100, this includes a lift sensor 138 and a tilt sensor 140. The lift sensor 138 is positioned with one portion connected to the front chassis 104 and another portion which rolls along the underside of the boom 110 in a cam-follower type of arrangement. The lift sensor 138 is thereby able to provide a signal indicative of a position of the boom 110, specifically the angle of the boom 110 relative to the front chassis 104. A tilt sensor 140 is positioned with one portion connected to the boom 110 and another portion connected to the bellcrank 112. The tilt sensor 140 is thereby able to provide a signal indicative of a position of the bellcrank 112 relative to the boom 110.

Each of the lift sensor 138 and the tilt sensor 140 are in communication with a controller 142. The controller 142 receives the signals provided by these sensors, and values for the distances between the pins of the linkage 108 (i.e., the known geometry of the linkage 108), and can determine the posture of the linkage 108 including any number of angles or positions. For example, the controller 142 can determine the position of the base axis 126*c* relative to the front chassis 104 by applying trigonometry to the length from the boom pin 116 to the base pins 126*b* and the angle provided by the lift sensor 138. In a similar manner, the controller 142 can determine the positions of the top axis 124*c* and the tip axis 132 (and thus the heights of these), and provide values such as the angle of the forks 122 relative to the ground surface 130, using known distances between pins and the signals from the lift sensor 138 and the tilt sensor 140. By determining the changes in these positions over time, the controller 142 is also able to determine the velocity or acceleration for any of these positions of the linkage 108 and the forks 122. In this way, the lift sensor 138 and the tilt sensor 140 are each providing signals indicative of the position, velocity, and acceleration of the linkage 108 and the forks 122. Specifically, these sensors are each providing signals indicative of the position, velocity, and acceleration of the forks 122, including the tip 128 and the tip axis 132.

As used herein, "controller" is intended to be used consistent with how the term is used by a person of skill in the art, and refers to a computing component with processing, memory, and communication capabilities which is utilized to control or communicate with one or more other components. In the embodiment illustrated in FIG. 1, the controller 142 is a vehicle control unit (VCU) which controls multiple functions of the work vehicle 100, but in alternate embodiments it could be a standalone controller.

FIG. 1 illustrates the placement of sensors in one embodiment, but alternate embodiments may utilize different placements or sensors measuring different types of data. As one example, an IMU may be placed on one of the base pins 126*b* and provide a signal indicative of three orthogonal linear accelerations and three angular velocities about three orthogonal axes. The controller 142 may receive this IMU signal and determine the position of one of the base pins 126*b* and, if the base pins 126*b* rotate with the forks 122, the angle of the forks 122. The accuracy of these calculations may be increased by data from an additional sensor, such as the lift sensor 138, to prevent error accumulation over time. As another example, an IMU may be placed at the tip 128 and directly provide the linear accelerations and angular velocities experienced by the tip 128, enabling the controller 142 to calculate any number of relevant positions, velocities, or accelerations, with an additional absolute angular sensor on one or more portions of the linkage 108 to correct for drift and error accumulation over time.

FIG. 2*a* shows a portion of the work vehicle 100 with the forks 122 tilted backward/upward (i.e., counterclockwise) relative to the ground surface 130. An operator operating the work vehicle 100 from an operator station 144 may actuate a control lever to control the lift cylinders 134 to raise the boom 110 until the tip axis 132 is aligned with slots 146 in a pallet 148, with the tip axis 132 at a height 150. The operator may then actuate an operator switch 152 located within the operator station 144. Upon actuation of the operator switch 152, the controller 142 actuates the lift cylinders 134 and the tilt cylinder 136 to level the forks 122. The controller 142 actuates both the lift cylinders 134 and the tilt cylinder 136 by the proper amounts to achieve a net movement by the forks 122 of a rotation about the tip axis 132. This allows the forks 122 to change their angle to level while still ending up with the tip axis 132 at the height 150. Once the controller 142 actuates the forks 122 to the level position, which is shown in FIG. 2*b*, the work vehicle 100 can be driven forward to engage the forks 122 in the slots 146 of the pallet 148 as the forks 122 are already at the appropriate height 150. In alternate embodiments, the controller 142 may be triggered to perform this leveling operation in ways other than the actuation of an operator switch or other operator input, such as based on the location of work vehicle 100, its proximity to a pallet, or how the operator is operating the linkage 108.

In FIG. 2*a* and FIG. 2*b*, the height 150 of the tip axis 132 and tip 128 is shown relative to the ground surface 130 supporting the work vehicle 100, but in practice the height would often be measured relative to a point on the chassis 102 (such as the boom pin 116) or another reference point in a fixed relationship to the chassis 102. In alternate embodiments, a height of the tip 128 may be measured relative to something external to the work vehicle 100.

The controller 142 effectuates its actuation of the lift cylinders 134 and the tilt cylinder 136 by controlling a series of electrohydraulic valves (not shown). The controller 142 provides a voltage signal to the electrohydraulic valves that open and close such valves, thereby controlling the flow of hydraulic fluid from the hydraulic pumps of the work vehicle 100 to the lift cylinders 134 and the tilt cylinder 136. In alternate embodiments, the controller 142 may actuate the cylinders in alternate manners, such as by directly controlling pump displacement to control the flow of fluid, or by actuating one or more components which in turn actuate valves to control the cylinders, such as relays, switches, clutches, or other controllers. The controller 142 may be configured so as to control the lift cylinders 134 and the tilt cylinder 136 based on a control system and sensor input, as described further below with reference to FIG. 3.

FIG. 3 is a flow chart of a control system 200 which the controller 142 may be configured to execute. The control system 200 is for the actuation of the lift cylinders 134 and the tilt cylinder 136 to level the forks 122 by achieving a net rotation of the forks 122 about the tip axis 132. In step 202, the controller 142 waits until it receives a command to level the forks 122, such as a signal from the operator switch 152.

In step 204, the controller 142 receives signals from the lift sensor 138 and the tilt sensor 140, which may be referred to as a lift signal and a tilt signal, respectively. In step 206, the controller 142 determines the starting height, or height at the time the fork level command was received, of the tip 128 and thus the tip axis 132 (e.g., the height 150 shown in FIG. 2*a* and FIG. 2*b*) using the signals received in step 204 and the known geometry of the linkage 108 and the forks 122. For example, the starting height may be 1 meter above the ground surface 130, or 0.5 meters below an axis of the boom pin 116, as two examples of reference points for determining the height. In step 208, the controller 142 determines the angle of the forks 122, for example 7 degrees, using the signals received in step 204 and the known geometry of the linkage 108 and the forks 122.

In step 210, the controller 142 actuates the tilt cylinder 136 in the appropriate direction to tilt the forks 122 towards the level position shown in FIG. 2*b*. If the forks 122 are initially in an upward tilted position, as shown in FIG. 2*a*, then the controller 142 retracts the tilt cylinder 136, which will tend to rotate the forks 122 downward (i.e., clockwise in FIG. 2*a*) toward the level position. If the forks 122 are initially in a downward tilted position, then the controller 142 extends the tilt cylinder 136, which will tend to rotate the forks 122 upward. If the forks 122 are already level, then the controller 142 will not actuate the tilt cylinder 136.

In step 212, the controller 142 actuates the lift cylinders 134 to counteract changes to the height of the tip 128 caused by the actuation in step 210. The result of steps 210 and 212 is that the controller 142 will be actuating the lift cylinders 134 and the tilt cylinder 136 to cause the forks 122 to achieve a net motion of rotation about the tip axis 132 to level the forks 122 without changing the height of the tip 128. There are multiple ways that step 212 can be done. Controller 142 does this with control system 200 by determining the rate at which the actuation of the tilt cylinder 136 in step 210 will change the height of the tip 128. It then actuates the lift cylinders 134 in a direction and at a rate which causes an opposite effect on the height of the tip 128. For example, if the controller 142 is retracting the tilt cylinder 136 at 0.2 m/s in step 210, then the controller 142 in step 212 may (i) determine that this actuation of the tilt cylinder 136 would cause the tip 128 to fall by 0.4 m/s based on the kinematics and current position of the linkage 108 and the forks 122 (based on the lift signal and the tilt signal), which may be referred to as an expected change in height, (ii) determine, based on the kinematics and current position of the linkage 108 and the forks 122, that extending the lift cylinders 134 by 0.3 m/s would cause the tip 128 to rise by 0.4 m/s and thus will counteract the actuation of the tilt cylinder 136, then (iii) actuate the lift cylinders 134 by 0.3 m/s in the extending direction. This configuration of the controller 142 would allow the work vehicle 100 to level the forks 122 while keeping the height of the tip 128 unchanged during the leveling process. This example also makes clear that the controller 142 is able to perform step 210 and step 212 in parallel, and need not wait until actuation of the tilt cylinder 136 is complete before actuating the lift cylinders 134 to keep the height of the tip 128 unchanged.

As an alternate embodiment, the controller 142 in step 212 may perform a closed loop control by sensing change in the height of the tip 128 and then actuating the lift cylinders 134 based on this change to bring the tip 128 back to its original height. Controller 142 could do this by comparing the current height of the tip 128 based on the most recent signals from the lift sensor 138 and the tilt sensor 140 to the starting height of the tip 128 determined in step 206. If a negative change is found, such as determining the tip 128 is 0.1 meters below its starting height, the controller 142 can extend the lift cylinders 134 to help raise the tip 128 back toward its starting height. In one variation, the rate at which the lift cylinders 134 are actuated can be proportional to the height error (difference between the current height of the tip 128 and its starting height), which would make the rate based on the magnitude of the height error or change in height. In another variation, a PID control (proportional-integral-derivative control) can be used on the height error to determine the rate at which the lift cylinders 134 are actuated. This configuration of the controller 142 would not keep the height of the tip 128 unchanged during the leveling process, but would reduce errors in the height of the tip 128 during the leveling process.

In both the FIG. 3 embodiment and the alternate embodiment above, the forks 122 experience a net motion of a rotation about the tip axis 132 instead of the base axis 126*c* such that the height of the tip 128 remains unchanged instead of the height of the base pins 126*b* remaining unchanged. Due to the kinematics of the linkage 108, however, the forward and rearward position of the tip 128 (in the direction 101*a*) may change throughout the leveling operation. Even though the position of the tip 128 may change along the direction 101*a*, herein it is still considered to be rotation about the tip axis 132 if the position of the tip 128 is unchanged along the direction 101*b*. In alternate embodiments, a powertrain of the work vehicle 100 may be controlled by the controller 142 to move the work vehicle 100 forward or rearward in such a manner to counteract changes to the position of the tip 128 along the direction 101*a* caused by the leveling process (i.e., actuation of the lift cylinders 134 and the tilt cylinder 136). In such alternate embodiments, the tip 128 may not change position along the direction 101*a* during the leveling process.

In step 214, the controller 142 receives updated signals from the lift sensor 138 and the tilt sensor 140. In step 216, the controller 142 uses the signals received in step 214 to determine the angle of the forks 122, like in step 208, and to determine the height of the tip 128, like in step 206. The controller 142 then determines if the forks 122 are level and the tip 128 is at the starting height determined in step 206. If both of those are true, the controller 142 ceases any ongoing actuation of the lift cylinders 134 and the tilt cylinder 136 and proceeds to step 202, where it awaits the next fork level command. If either of those items are false, the controller 142 proceeds to step 210. The controller 142 thereby performs a loop of steps 210, 212, 214, and 216, actuating the lift cylinders 134 and the tilt cylinder 136 to effectuate a rotation of the forks 122 about the tip axis 132 until the forks 122 are level and the tip 128 is at the starting height.

In the embodiment shown in FIG. 3, the controller 142 actuates the tilt cylinder 136 and uses signals from the lift sensor 138 and the tilt sensor 140 to actuate the lift cylinders 134 to counteract changes in the height of the tip 128 in a loop of steps 210, 212, 214, and 216. In alternate embodiments, the controller 142 could instead calculate the positions for the lift cylinders 134 and the tilt cylinder 136 (i.e., target cylinder positions) which would result in level forks 122 with an unchanged height for tip 128 (i.e., a target position for the forks 122), and then just actuate all three cylinders until those positions are achieved. This configuration of the controller 142 would not keep the height of the tip 128 unchanged during the leveling process, but the net result at the end of the leveling process would be that the forks 122 would have experienced a net motion of rotation about the tip axis 132 to be level with an unchanged height for the tip 128.

Without in any way limiting the scope, interpretation, or application of the claims appearing below, a technical effect of one or more of the example embodiments disclosed herein is a faster and more efficient method of controlling the actuators of a linkage to level a work tool connected to the linkage without changing the height at a tip of the work tool. While the height of the tip of the work tool may be the same before and after the leveling operation, the height may change during the leveling process in certain embodiments, and the forward and backward position of the tip may also change throughout the leveling process and even at the end of the leveling process, depending on the nature of the linkage involved.

While the present disclosure has been illustrated and described in detail in the drawings and foregoing description, such illustration and description is not restrictive in character, it being understood that illustrative embodiment (s) have been shown and described and that all changes and modifications that come within the spirit of the present disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A work vehicle comprising:

a chassis;

a linkage;

a work tool movably connected to the chassis by the linkage, the work tool pivotally connected to the linkage about a base axis, the work tool comprising a tip positioned at a forward end of the work tool;

a tip axis parallel to the base axis and passing through the tip;

a first actuator connected to the linkage;

a second actuator connected to the linkage;

one or more sensors, the one or more sensors configured to provide one or more signals indicative of at least one of a position, velocity, and acceleration of the work tool;

an operator switch, wherein a controller is in communication with the operator switch and is further configured to actuate, when the operator control switch is actuated by an operator input, the first actuator and the second actuator to level the work tool by rotating the work tool about the tip axis; and the controller configured to actuate, based on the one or more signals, the first actuator and the second actuator to level the work tool by rotating the work tool about the tip axis;

actuate the first actuator and the second actuator to level the work tool without changing a height of the tip during actuation of the first actuator and the second actuator.

2. The work vehicle of claim 1, wherein the controller is further configured to determine a height of the tip and an angle of the work tool based on the one or more signals.

3. The work vehicle of claim 1, wherein the first actuator is a first hydraulic cylinder, the second actuator is a second hydraulic cylinder, and the work tool is a set of forks, and the controller is further configured to:

determine a current position of the set of forks based on the one or more signals, wherein the tip is at a height and the set of forks are not level in the current position;

determine a target position of the set of forks, wherein the tip is at the height and the set of forks are level in the target position;

determine a target position for the first hydraulic cylinder corresponding to the target position of the set of forks;

determine a target position for the second hydraulic cylinder corresponding to the target position of the set of forks;

actuate the first hydraulic cylinder to the target position for the first hydraulic cylinder; and actuate the second hydraulic cylinder to the target position for the second hydraulic cylinder.

4. The work vehicle of claim 1, wherein the controller is further configured to: actuate the second actuator to rotate the work tool about the base axis; and actuate the first actuator, based on the one or more signals, to counteract changes in a height of the tip.

5. The work vehicle of claim 1, wherein the controller is further configured to: actuate the second actuator to rotate the work tool about the base axis;

determine a change in a height of the tip resulting from actuation of the second actuator; and actuate the first actuator based on the change in the height.

6. The work vehicle of claim 5, wherein the controller is further configured to actuate the first actuator at a rate, the rate based on a magnitude of the change in the height.

7. A method for controlling a work tool movably connected by a linkage to a chassis of a work vehicle, the work tool pivotally connected to the linkage about a base axis, the work tool comprising a tip positioned at a forward end of the work tool, the method comprising:

receiving one or more sensor signals at a controller, the one or more sensor signals indicative of at least one of a position, velocity, and acceleration of the work tool; and actuating, with the controller, a tilt actuator and a lift actuator to rotate the work tool about a tip axis based on the one or more sensor signals, the tilt actuator connected to the linkage and configured to rotate the work tool about the base axis when actuated, the lift actuator connected to the linkage and configured to raise or lower the base axis when actuated, the tip axis parallel to the base axis and passing through the tip, wherein, based on an operator input to an operator switch, the tilt actuator and the lift actuator move the work tool to a position where the work tool is level.

8. The method of claim 7, further comprising:

determining a height of the tip based on the one or more signals; and actuating, with the controller, the tilt actuator and the lift actuator based on the height.

9. The method of claim 8, wherein the work tool is a set of forks, and the tip stays at the height during actuation of the tilt actuator and the lift actuator.

10. The method of claim 7, wherein the actuating step comprises:

actuating the tilt actuator until the work tool is level; and actuating, while the tilt actuator is being actuated, the lift actuator based on the one or more sensor signals to counteract an effect of actuation of the tilt actuator on a height of the tip axis.

11. A work vehicle comprising:

a chassis;

a linkage, the linkage comprising:

a boom, a first end of the boom pivotally connected to the chassis;

lift cylinders, first ends of the lift cylinders pivotally connected to the chassis, second ends of the lift cylinders pivotally connected to the boom;

a bellcrank pivotally connected to the boom;

a tilt cylinder pivotally connected to a first end of the bellcrank; and a lower link, a first end of the lower link pivotally connected to a second end of the bellcrank;

a set of forks, the set of forks pivotally connected to a second end of the boom, the set of forks pivotally connected to a second end of the lower link, the set of forks comprising a tip positioned at a forward end of the set of forks;

a lift sensor configured to provide a lift signal indicative of an angle of the boom relative to the chassis;

a tilt sensor configured to provide a tilt signal indicative of an angle of the bellcrank relative to the boom; and a controller in communication with the lift sensor and the tilt sensor, the controller configured to actuate, based on the lift signal and the tilt signal, the lift cylinders and the tilt cylinder to rotate the set of forks from a tilted position with the tip at a height to a level position with the tip at the height;

actuate the lift cylinders and the tilt cylinder to rotate the set of forks from the tilted position to the level position without the height changing during rotation;

an operator switch, wherein the controller is in communication with the operator switch and further configured to actuate, when the operator switch is actuated and based on the lift signal and the tilt signal, the lift cylinders and the tilt cylinder to rotate the set of forks from the tilted position with the tip at the height to the level position with the tip at the height.

12. The work vehicle of claim 11, wherein the controller is further configured to determine the height and an angle of the set of forks based on the lift signal and the tilt signal.

13. The work vehicle of claim 11, wherein the controller is further configured to:

determine the height based on the lift signal and the tilt signal;

actuate the tilt cylinder; and actuate the lift cylinders based on changes in the height.

14. The work vehicle of claim 11, wherein the controller is further configured to:

actuate the tilt cylinder;

determine an expected change in the height resulting from actuation of the tilt cylinder; and actuate the lift cylinders based on the expected change in the height.

15. The work vehicle of claim 14, wherein the controller is further configured to actuate the lift cylinders at a rate, the rate based on a magnitude of the expected change in the height.

* * * * *